US006676477B2

(12) United States Patent
Dan et al.

(10) Patent No.: US 6,676,477 B2
(45) Date of Patent: Jan. 13, 2004

(54) TOY HAVING DETACHABLE CENTRAL PROCESSING UNIT

(75) Inventors: Byung Ju Dan, Sungnam (KR); Jong Rak Lim, Yongin (KR); Jae Ho Na, Kuri (KR); Jang Won Boo, Seoul (KR); Hee Il Wang, Seoul (KR); Nam Woong Kim, Seoul (KR); In Sang Song, Uiwang (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/931,346

(22) Filed: Aug. 16, 2001

(65) Prior Publication Data

US 2002/0061702 A1 May 23, 2002

(30) Foreign Application Priority Data

Aug. 18, 2000 (KR) ..... 2000-47832

(51) Int. Cl.[7] ..... G09B 9/00
(52) U.S. Cl. ..... 446/298; 463/1
(58) Field of Search ..... 446/297, 298, 446/299, 300, 301, 175; 463/1, 35, 39, 30, 36, 31; 706/11, 45

(56) References Cited

U.S. PATENT DOCUMENTS 5,752,880 A * 5/1998 Gabai et al. ..... 463/1
6,012,961 A * 1/2000 Sharpe et al. ..... 446/298
6,149,490 A * 11/2000 Hampton et al. ..... 446/353

FOREIGN PATENT DOCUMENTS

JP 11-126017 5/1999
JP 11-188678 7/1999

* cited by examiner

*Primary Examiner*—Jacob K. Ackun
(74) *Attorney, Agent, or Firm*—Lee, Hong, Degerman, Kang & Schmadeka

(57) ABSTRACT

A toy having a detachable central processing unit is disclosed and includes a central processing unit having a growth algorithm for learning purposes, a driving unit for exhibiting learned actions and functions, and a link unit for linking the central processing unit and the driving unit. When the central processing unit is detached from the driving unit, the toy can learn via a cyber character or can be utilized as a Personal Digital Assistant (PDA), mobile phone, or a personal computer. When the driving unit is linked to the central processing unit, the toy's learning abilities are improved.

6 Claims, 7 Drawing Sheets

FIG. 6

| PERIOD OF GROWTH | STEP OF GROWTH | EXHIBITION OF ACTION |
|---|---|---|
| 1 MONTH | INFANT | CRAWLING MANNER,CRYING |
| 2 MONTH | CHILD | AWKWARD WALKING MANNER,USING SIMPLE WORDS |
| 3 MONTH | ADOLESCENT | COMPLETE WALKING,OPPPSITE ACTION TO USER COMMAND,VISION TRACKING OF SIMPLE SUBSTANCE |
| 4 MONTH | ADULT | FAST WALKING AND VISION |
| 5 MONTH | MIDDLE AGE | SLOW WALKING AND VOICE,TRACKING SPEED SLOWDOWN |
| 6 MONTH | OLD | ACTIVITY DECLINE,SLOW RESPONSE TO USER |

FIG. 7

| PERIOD OF GROWTH | STEP OF GROWTH | EXHIBITION OF ACTION |
|---|---|---|
| 1 MONTH | INFANT | CRYING,FREQUENT MEAL,EXCRET AND SLEEP |
| 2 MONTH | CHILD | USE SIMPLE WORDS,ASK FOR LEARNING AND PLAY |
| 3 MONTH | ADOLESCENT | REJECT TO ORDER OF USER,ASK FOR PLAY, INCREASE IN ACTIVITY |
| 4 MONTH | ADULT | ABLE TO RECOGNIZE USER'S VOICE,ACTION OF ON-SCREEN CHARACTER RESPONDING TO RECOGNIZED WORDS |
| 5 MONTH | MIDDLE AGE | DECLINE IN SPEED OF VOICE RECOGNITION |
| 6 MONTH | OLD | ACTION SPEED DECLINE OF ON-SCREEN CHARACTER,SLOW RESPONSE TO USER,FREQUENT SLEEP MODE |

TOY HAVING DETACHABLE CENTRAL PROCESSING UNIT

CROSS REFERENCE TO RELATED APPLICATIONS

Pursuant to 35 U.S.C. §119(a), this application claims the benefit of earlier filing date and right of priority to the Korean Application No. 2000-47832, filed on Aug. 18, 2000, the content of which is hereby incorporated by reference herein in its entirety

BACKGROUND OF THE INVENTION

1. Field of the Invention

The present invention relates to a learning/growing toy, and particularly, to a learning/growing toy having a detachable central processing unit.

2. Description of the Background Art

Generally, a learning/growing toy is an intelligent toy having a program which allows the toy to eventually react, after a period of learning, to a user's command via a remote control command or other voice recognizing art. For example, such a toy has a program that if it learns through a command of a user's voice, sound, light and/or contact, the toy interacts with them. Namely, the learning/growing toy has a program where the toy reacts to learning by a user so that it grows intelligently and functionally.

Here, a toy learns according to a user has a body unit for implementing motion and outputting the audio information as well as a central processing unit for determining action of the toy.

However, the central processing unit is fixed in the body of the toy and accordingly, the toy has a disadvantage that the user should always carry the toy in order to have the toy learn or grow.

Also, since the toy exhibits variable actions according to the self-control determination, a CPU of high-level performance and huge storage capacity is necessary to control respective apparatuses which compose the toy. Therefore, to compose hardware for the above toy requires a high cost even though the central processing unit has relatively simple uses.

SUMMARY OF THE INVENTION

Therefore, an object of the present invention is to provide a toy having a detachable central processing unit, in which the toy can learn when using the central processing unit only or to utilize the central processing unit as a Personal Digital Assistant (PDA), mobile phone, or as a personal computer.

To achieve these and other advantages and in accordance with the purpose of the present invention, as embodied and broadly described herein, there is provided a toy having a detachable central processing unit which is comprised of a toy which learns by receiving input from a user and a central processing unit which is separable from the toy.

Also, there is provided a method for operating a toy having a detachable central processing unit, which comprises the steps of: initializing a main board in the central processing unit, which includes a growth algorithm of the toy, by inputting power; determining whether the central processing unit is linked to a driving unit by communicating with a Digital Signal Processing Unit (DSPU) installed in the driving unit; switching to a self-control mode if the driving unit is linked to the central processing unit; initializing one or more motion control routines of the Digital Signal Processing Unit, a vision processor and an audio codec; and initiating software stored in a flash memory to operate to the toy in the self-control mode.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings are included to provide a further understanding of the invention and are incorporated in and constitute a part of this specification. These drawings illustrate embodiments of the invention and together with the description serve to explain the principles of the invention.

In the drawings:

FIG. 6 is a table showing growth steps in the case of self-control growth mode in accordance with an embodiment of the present invention; and FIG. 7 is a table showing growth steps in the case of separate growth mode in accordance with an embodiment of the present invention.

DETAILED DESCRIPTION OF THE PREFERRED EMBODIMENTS

Reference will now be made in detail to the preferred embodiments of the present invention, examples of which are illustrated in the accompanying drawings.

Figure 1:
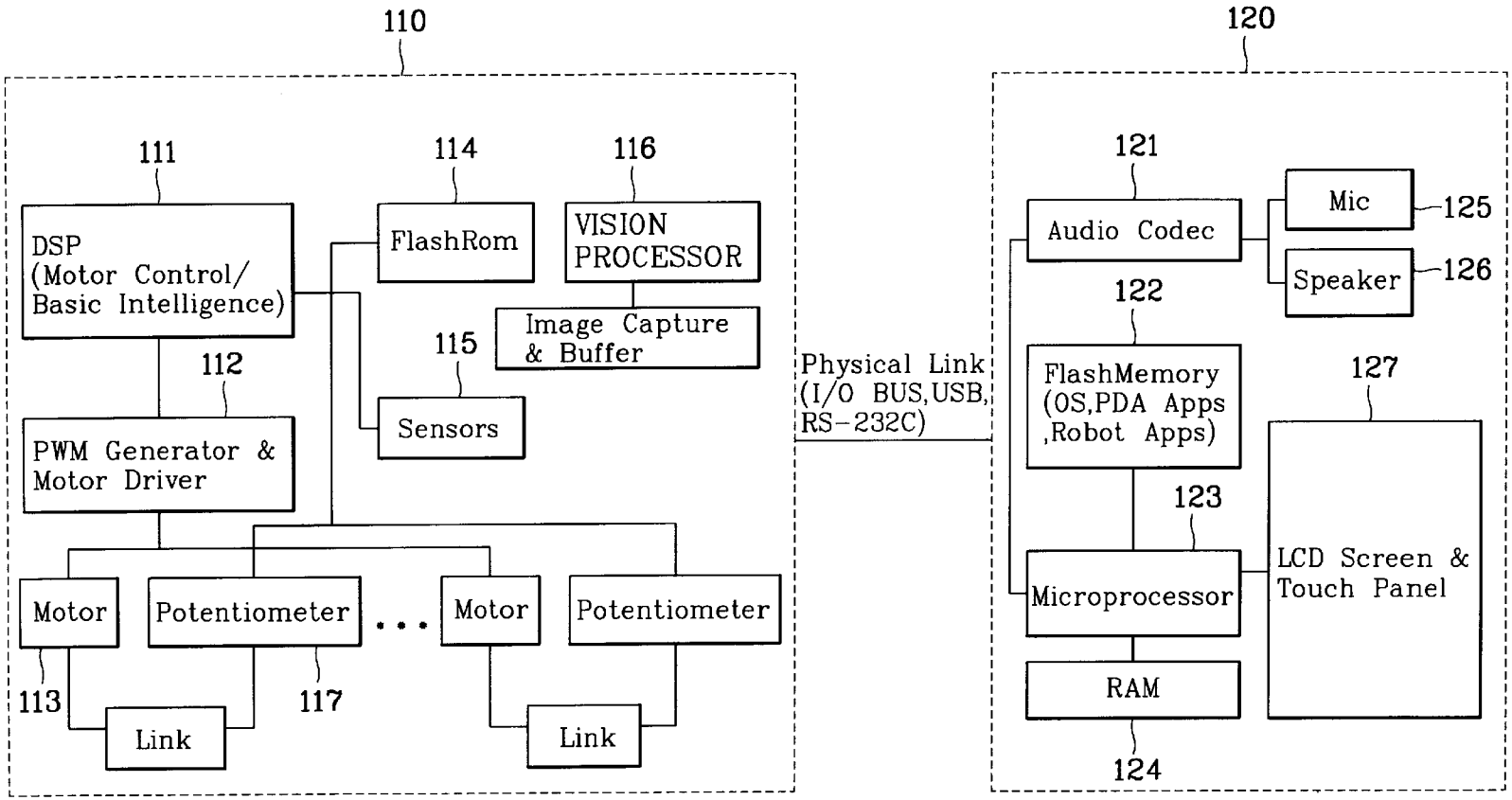
FIG. 1 is a block diagram showing the interaction of respective components in accordance with an embodiment of the present invention.

FIG. 1 is a block diagram showing the interaction of respective components in accordance with an embodiment of the present invention. As shown in the drawing, a toy, which learns by receiving input from a user, comprises a central processing unit 120 which is separable from the toy, a driving unit 110 for exhibiting action or outputting audio information, and a link unit for linking the central processing unit 120 and the driving unit 110.

The central processing unit 120 comprises a microphone 125 and a speaker 126 for inputting and outputting the audio information, respectively, audio codec 121 for processing the audio signal inputted and outputted from the microphone 125 and speaker 126, respectively, flash memory 122 for storing an operating application/program and learned information, RAM 124 for reading and writing information stored from learning, a LCD screen and touch panel 127 for inputting and outputting function selection and learned information, and a microprocessor 123 for transmitting certain motion commands to the driving unit 110.

The driving unit 110 is comprised of a motor 113, a motor drive 112 for driving the motor 113, vision processor 116 for capturing and storing a vision in a buffer, flash ROM 114, potentiometer 117, sensor 115 for sensing an outside stimulation, and a Digital Signal Processing Unit (DSPU) 111. The DSPU 111 decodes a command for implementing a certain motion and transmits the decoded command to the motor drive 112.

The link unit comprises a physical link means such as an I/O BUS, USB or a RS-232C.

Figure 2:
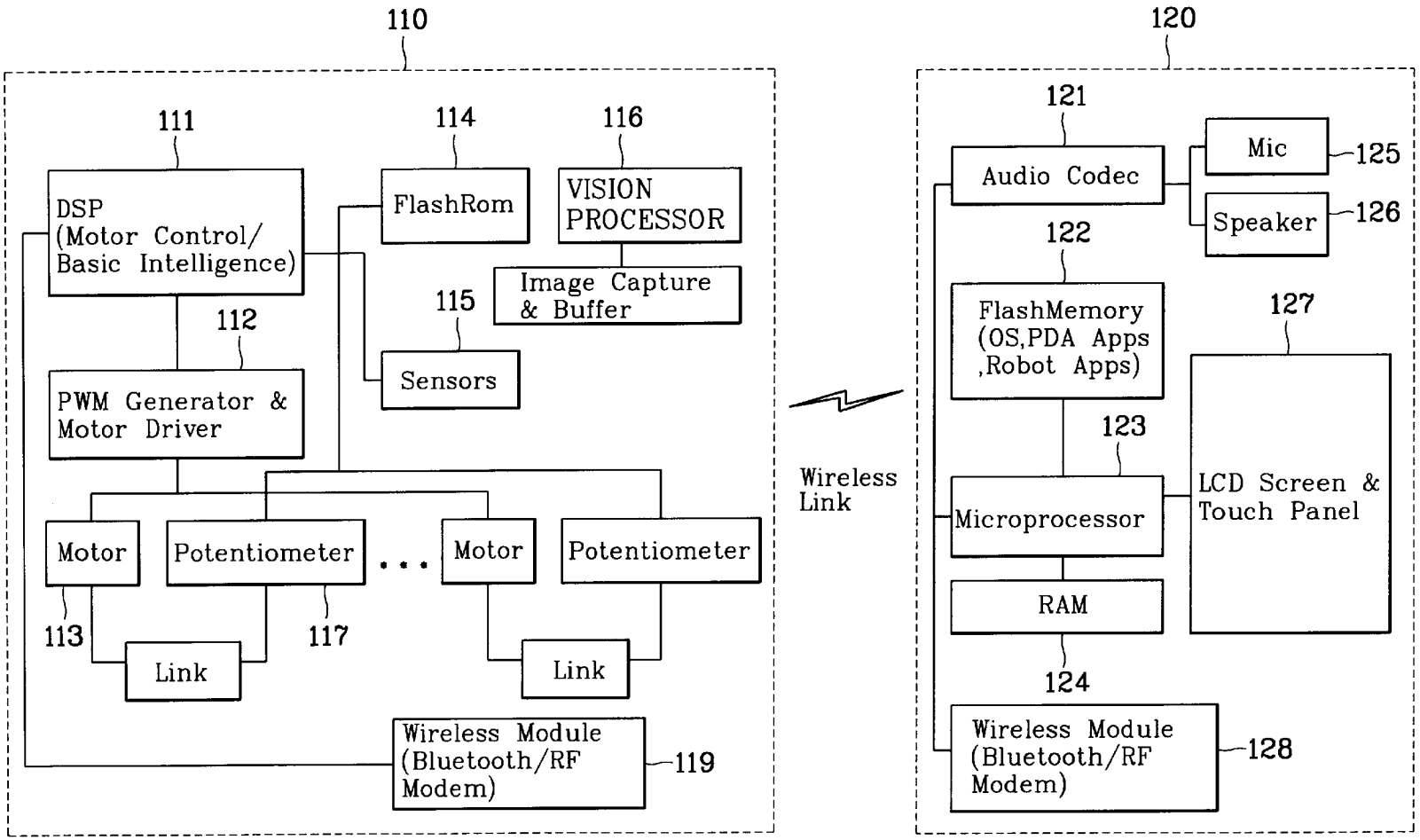
FIG. 2 is a block diagram showing an embodiment of the toy in accordance with an embodiment of the present invention.

With respect to FIG. 2, the link unit can also comprise a wireless link means. A wireless link means would be connected by mounting a wireless module such as a Bluetooth chip or RF modem in the central processing unit 120 and in the driving unit 110, respectively.

A method for operating a toy having a detachable central processing unit is described as follows.

A first step of driving a toy in self-control mode is to operate the program stored in the flash memory 122 from the central processing unit 120. Furthermore, learned contents inputted through operation of the LCD screen and the touch panel 127 are stored in the flash memory 122. The learned contents can also be used to operate the toy in self-control mode. The microprocessor 123 transmits a certain motion command to the driving unit 110 that reflects the learned contents. The microprocessor 123 and the driving unit 110 are connected by a physical link or wireless link means. Subsequently, the motion command is transmitted to the driving unit 10 for implementing the certain motion. The driving unit 110 decodes the motion command and transmits the decoded command to the motor drive, which then drives the motor 113.

The central processing unit 120 includes a growth algorithm and can be operated in a learning or separate growth mode when separated from the toy. Consequently, a cyber character which exists in the central processing unit 120, can learn. Furthermore, the central processing unit 120 can be used as an apparatus having communicating functions, such as a PDA, mobile phone, or personal computer, by adding an application program to the central processing apparatus 123 when in the learning or separate growth mode.

Namely, the toy operates in a corresponding self-control growth mode or separate growth mode according to whether the central processing unit 120 is mounted or detached to the toy. Accordingly, the toy exhibits motions and outputs audio information based on the stored operating application/program and learned contents.

Figure 3:
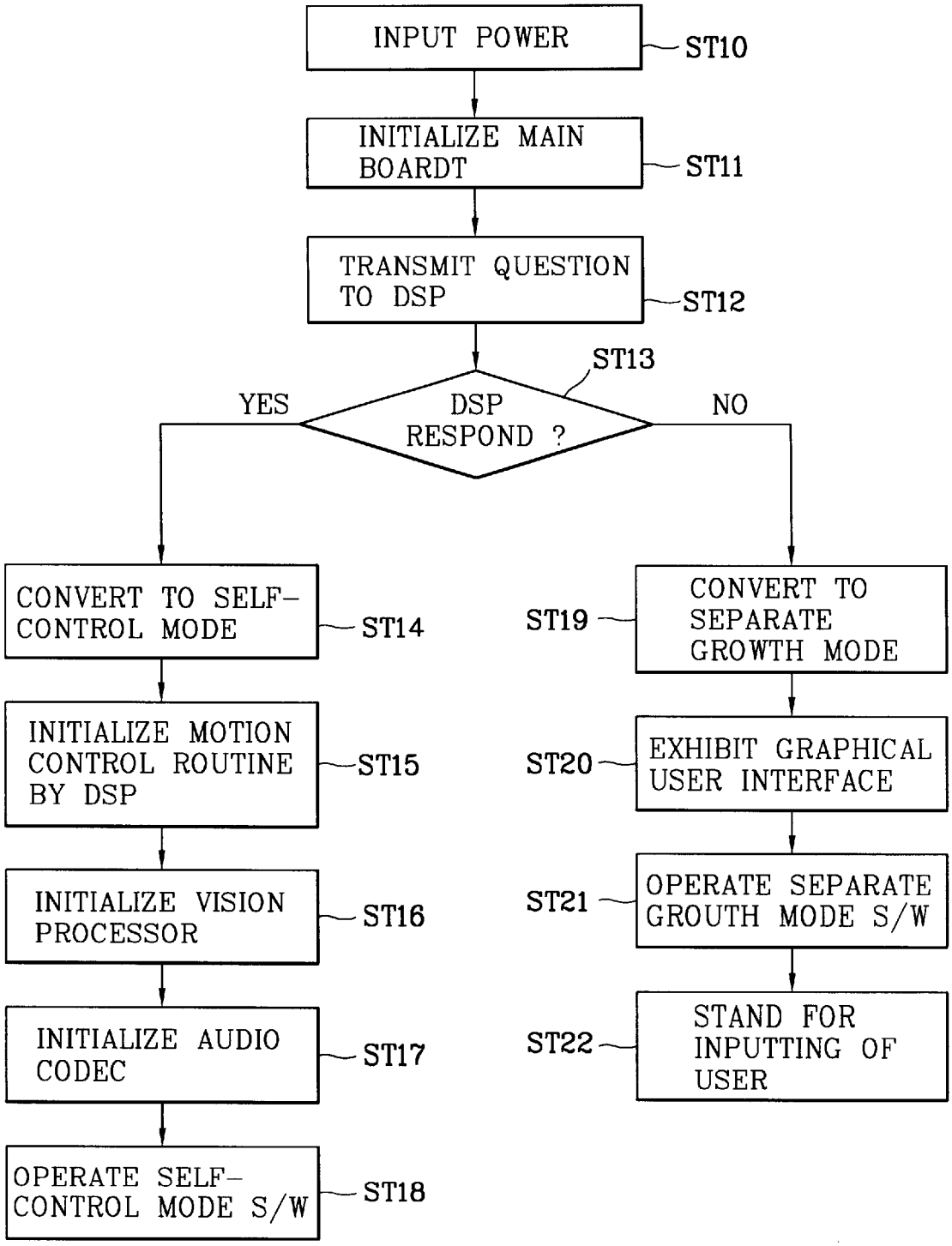
FIG. 3 is a flow chart showing actions for determining the learning mode in accordance with an embodiment of the present invention.

FIG. 3 is a flow chart for determining the learning mode in accordance with an embodiment of the present invention. A method of determining the proper mode comprises the steps of initializing the main board in the central processing unit 120 by inputting power ST10 and ST11, questioning the DSPU 111 to determine whether the driving unit 110 is linked ST12 and ST13, switching to the self-control mode in case the driving unit 110 is linked ST14, initializing the motion control routine of the DSPU 111, vision processor 116 and the audio codec 121 ST15, ST16 and ST17, and operating the self-control mode stored in the flash memory 122 ST18.

In cases where the driving unit 110 is not linked, the operation of the toy comprises the steps of switching to the separate growth mode ST19, exhibiting a graphic user interface in the LCD screen and built-in type touch panel 127 ST20, operating the software of the separate growth mode stored in the flash memory 122 ST21, and receiving input from a user ST22, wherein voice information is outputted and the cyber character which exists in the central processing unit 120 is developed.

Figure 4:
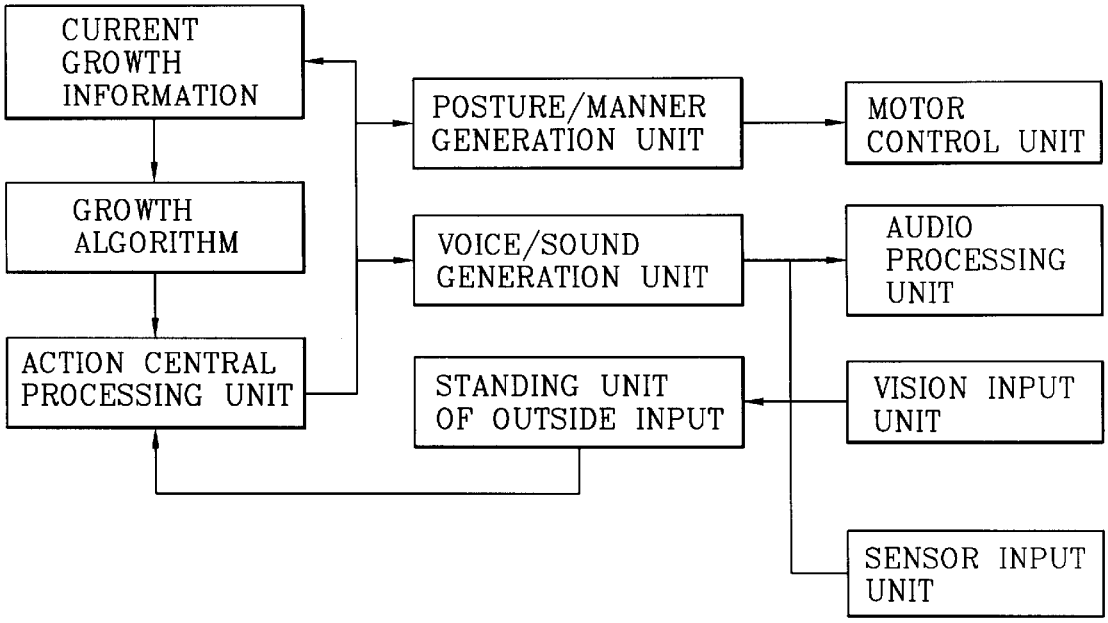
FIG. 4 is a block diagram showing the control signal in the case of self-control growth mode according to an embodiment of the present invention.

FIG. 4 is a block diagram showing a control signal in the self-control mode according to an embodiment of the present invention. The cyber character learns certain motion/voice actions via input from the LCD screen and touch panel 127. Subsequently, the microprocessor 123 outputs certain voice/sound actions from the speaker 126 via an action command to the audio codec 121. The DSPU 111 receives an input of a certain motion generation command from the microprocessor 123 and controls the motor drive 112. Accordingly, the microprocessor implements the certain motion. Therefore, the toy in the self-control mode exhibits certain motor functions by receiving information inputted from the posture/manner generation unit outputs audio information by receiving information inputted from the voice/sound generation unit, and performs vision tracking of a substance by receiving information inputted from a visual input unit, such as a camera.

Figure 5:
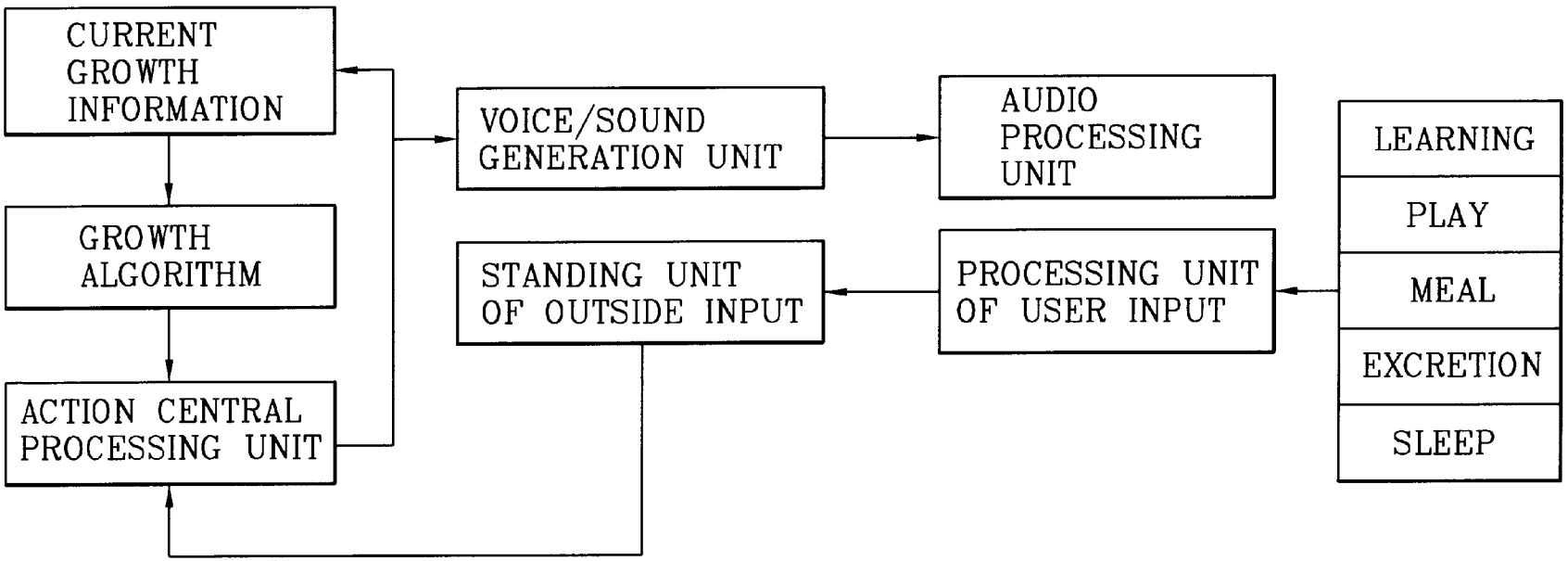
FIG. 5 is a block diagram showing the control signal in the case of separate growth mode in accordance with an embodiment of the present invention.

FIG. 5 is a block diagram showing a control signal in the separate growth or learning mode in accordance with an embodiment of the present invention. The user inputs a certain function, for example, learning, play, meal, or sleep, using the LCD screen built-in type touch panel 127. Subsequently, the microprocessor 123 outputs the voice/sound generation command corresponding to the currently inputted function to the audio codec 121. Accordingly, the microprocessor 123 outputs the voice/sound generated by the audio codec, virtually exhibiting the action of the cyber character according to the inputted content on the LCD screen and touch panel 127. In addition, the learned information is stored in the flash memory 122.

The learning methods illustrated in FIG. 4 and FIG. 5 are examples of implementing learned behavior. FIG. 6 is a table showing growth steps in the self-control mode in accordance with an embodiment of the present invention. As shown in FIG. 6, the toy exhibits a motion and outputs the voice information according to the growth period and growth step. Also, FIG. 7 illustrates a table showing growth steps in the separate growth mode in accordance with an embodiment of the present invention. The cyber character virtually exhibits learned actions on the LCD screen 127 according to the growth period and growth step and outputs corresponding voice information.

By having a detachable central processing unit 120 and driving unit 110, the cyber character of the present invention can learn a certain actions when the central processing unit 120 is separated from the toy. Also, when linking the central processing unit to the driving unit, the toy can perform more improved actions and provide a variety of learning instances, thus attracting a greater variety of interest.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims. Therefore, all changes and modifications that fall within the meets and bounds of the claims, or equivalence of such meets and bounds are intended to be embraced by the appended claims.

What is claimed is:

1. An operation method of a toy having a detachable central processing unit, comprising the steps of:

initializing a main board in the central processing unit, which includes a growth algorithm of the toy;

determining whether the central processing unit is linked to a driving unit by communicating with a Digital Signal Processing Unit (DSPU) installed in the driving unit;

switching to a self-control mode if the driving unit is linked to the central processing unit;

initializing one or more motion control routines of the Digital Signal Processing Unit, a vision processor and an audio codec; and executing software stored in a flash memory to operate the toy in the self-control.

2. The operation method of claim 1, further comprising the steps of:

switching to a separate growth mode if the driving unit is not linked to the central processing unit;

exhibiting a graphic user interface on a visual display including a built-in type touch panel to provide for a user interactions with a virtual cyber character;

executing software stored in the flash memory to operate the toy in the separate growth mode; and having the cyber character learn based on the a user interaction, wherein the cyber character interacts with the user.

3. The method of claim 1, wherein the toy exhibits motor functions by receiving information inputted from a posture/manner generation unit, outputs audio information by receiving information inputted from a voice/sound generation unit, and performs vision tracking of a substance by receiving information inputted from a visual input unit.

4. The method of claim 2, wherein the central processing unit outputs audio information by receiving information inputted from a voice/sound generation unit and exhibits actions performed by the cyber character on the visual display.

5. The method of claim 4, wherein the user inputs one or more function commands into the built-in type touch panel of the visual display.

6. The method of claim 5, wherein the cyber character functions according to the a programmed growth period and growth step.

* * * * *